US006869116B2

(12) United States Patent
Dalsing

(10) Patent No.: US 6,869,116 B2
(45) Date of Patent: Mar. 22, 2005

(54) LOCKSET WITH EXTERNAL CLUTCHING ASSEMBLY

(75) Inventor: Troy A. Dalsing, Calhan, CO (US)

(73) Assignee: Schlage Lock Company, Indianapolis, IN (US)

( * ) Notice: Subject to any disclaimer, the term of this patent is extended or adjusted under 35 U.S.C. 154(b) by 0 days.

(21) Appl. No.: 10/366,161

(22) Filed: Feb. 13, 2003

(65) Prior Publication Data

US 2004/0160068 A1 Aug. 19, 2004

(51) Int. Cl.[7] ..... E05B 3/00
(52) U.S. Cl. ..... 292/358; 292/336.3; 292/DIG. 61
(58) Field of Search ..... 292/336.3, 358, 292/165, 169, 170, DIG. 26, DIG. 61

(56) References Cited

U.S. PATENT DOCUMENTS

| | | | | | |
|---|---|---|---|---|---|
| 4,655,059 | A | * | 4/1987 | Best et al. | 70/224 |
| 4,698,989 | A | | 10/1987 | Zackerman | |
| 4,920,773 | A | | 5/1990 | Surko, Jr. | |
| 5,368,345 | A | | 11/1994 | Watts | |
| 5,474,348 | A | | 12/1995 | Palmer et al. | |
| 5,598,726 | A | | 2/1997 | Cordle | |
| 5,640,863 | A | | 6/1997 | Frolov | |
| 5,730,014 | A | * | 3/1998 | Berger et al. | 70/422 |
| 5,816,086 | A | | 10/1998 | Russell, IV | |
| 5,904,232 | A | * | 5/1999 | Shen | 192/69.62 |
| 5,916,281 | A | | 6/1999 | Kester et al. | |
| 5,927,777 | A | * | 7/1999 | Kuo et al. | 292/358 |
| 5,992,189 | A | * | 11/1999 | McCaa | 70/149 |
| 6,021,654 | A | * | 2/2000 | McCaa | 70/149 |
| 6,189,351 | B1 | * | 2/2001 | Eagan et al. | 70/472 |
| 6,264,255 | B1 | * | 7/2001 | Fortune | 292/336.3 |
| 6,286,347 | B1 | * | 9/2001 | Frolov | 70/472 |
| 6,297,725 | B1 | | 10/2001 | Tischendorf | |
| 6,354,121 | B1 | | 3/2002 | Frolov | |
| 6,527,314 | B2 | * | 3/2003 | Brown | 292/336.3 |
| 6,543,264 | B2 | | 4/2003 | Frolov | |
| 6,622,534 | B1 | * | 9/2003 | Miller et al. | 70/92 |

* cited by examiner

*Primary Examiner*—Gary Estremsky
(74) *Attorney, Agent, or Firm*—Michael Best & Friedrich LLP

(57) ABSTRACT

A lockset assembly having an external clutching assembly. The external clutch assembly includes a first spindle connected to a door lever. The door lever rotates to move a latch assembly between a locked and an unlocked position. A clutching torsion spring inter connects the first spindle to a hub. A clock spring inter connects the hub to a cage fixedly attached to a door. A second spindle inserts through the cage inter connects the hub and the latch assembly. Rotation of the door lever with the second spindle moves the latch assembly between an unlocked and locked position. The clutch assembly allows the lever and first spindle to rotate when the second spindle is constrained by the latch assembly in the locked position.

27 Claims, 4 Drawing Sheets

LOCKSET WITH EXTERNAL CLUTCHING ASSEMBLY

FIELD OF INVENTION

The present invention relates to a lockset assembly. More particular, this invention relates to a lockset assembly with an external clutching assembly.

BACKGROUND OF INVENTION

Lockset assemblies, more particular mortise locksets, generally comprise a latch assembly enclosed inside a door. The latch assembly includes a spring mechanism to bias a latch bolt into an extended or retracted position to secure the door to the door frame. The lockset assembly also includes an internal and an external door lever or knob mounted to the door and connected to the latch assembly to retract the latch bolt. Typically, such lockset assemblies are susceptible to vandalism from persons exerting excessive force on the external door lever that results in damage to the lockset assembly and escutcheon.

SUMMARY OF THE INVENTION

One embodiment of the invention is a clutching assembly that includes a hub that abuts between a first spindle and a second spindle. A clutching torsion spring interconnects the first spindle and the hub. The hub includes a recess with stops that limit rotation of the first spindle with respect to the hub. The underside of the hub includes an extension with a centrally located recess for receiving the second spindle. The extension of the hub inserts through an opening in a fixedly attached cage. The cage opening includes stops that engage stops integral the extension to limit rotation of the hub with respect to the cage. A clock spring interconnects the hub with a cage. The clutching assembly is such that the first spindle rotates when the second spindle is constrained with respect to the cage.

Another embodiment of the invention is a lockset assembly for securing access through a door. The lockset assembly includes a door lever and a latch assembly having a latch, wherein rotation of the door lever retracts the latch to a unlocked position or extends the latch to a locked position. A clutching assembly interconnects the door lever with the latch assembly. The clutching assembly includes a first spindle having one end connected to the door lever, a second spindle having one end connected to the latch assembly, and a cage fixedly attached to the door. A hub abuts between the other end of the first spindle the other end of the second spindle. The clutching assembly also includes a spring-over-spring clutching feature. A clutching torsion spring interconnects the first spindle and the hub, and a clock spring interconnects the hub and the cage. The lockset assembly is such that the door lever and connected first spindle rotates when the second spindle is constrained by the latch assembly.

One embodiment of a clutching assembly includes a cover and a connecting means that fixedly attaches the cover and the cage to a support (e.g., rose, escutcheon).

One embodiment of the hub includes a first slot and a second slot, wherein the first slot connects to one end of the first spring and the second slot connects to one end of the second spring. Another embodiment of the hub includes a recess having stops to limit rotation of the first spindle with respect to the hub. Another embodiment of the hub includes an extension attached to the underside of the hub with a recess for receiving the second spindle.

One embodiment of the cage includes a recess for positioning the hub and second spring. In another embodiment, the cage includes a cage opening for receiving the extension of the hub. The cage opening includes stops that engage stops on the extension to limit rotation of the hub with respect to the cage. In yet another embodiment, the case includes a first and a second slot. The clock spring connects to one of the first or second slots depending on whether the clutching assembly is connected to a left-hand swinging or right-hand swinging lever.

One embodiment of the second spindle is designed to break beyond a certain threshold force exerted on the lever. If the second spindle breaks, the first spindle and lever rotate freely. Another embodiment of the second spindle is identical to the first spindle, such that the first and second spindles are interchangeable.

The clutching assembly embodying the invention includes a spring-over-spring clutching feature that allows a lever to rotate a certain degree when the second spindle is constrained. When attached with a lock assembly to a door lever or the like (e.g., file cabinet handle, garage door handle, etc.), the clutching assembly reduces damage to the escutcheon and lock assembly from vandalism through the exertion of excessive force on the lever.

As is apparent from the above, it is an aspect of the invention to provide an external clutching assembly for a lockset assembly. Other features and aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
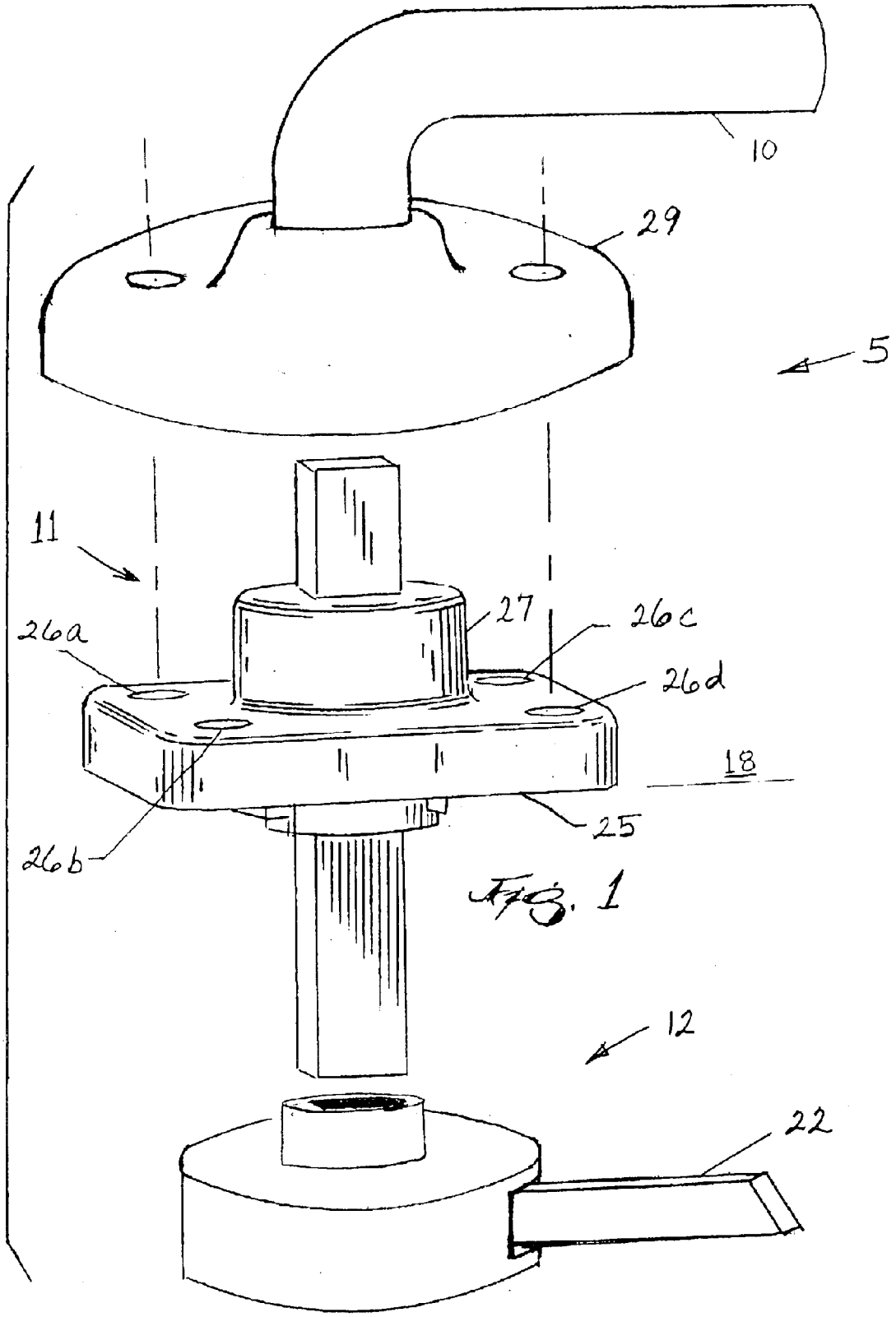
FIG. 1 is a perspective view of a lockset assembly that includes the clutching assembly embodying the invention.

FIG. 1 illustrates a perspective view of an exemplary lockset assembly 5 embodying the invention. The assembly 5 includes a lever 10, an external clutching assembly 11 and a latch assembly 12. The lever 10 in FIG. 1 can be any mechanism known to those in the art for operating a lockset 5 (e.g., handle, knob, etc.). As shown in FIG. 1, exemplary application of the lockset assembly 5 of the invention is for controlling access through a door 18. Of course, the lockset assembly can be used in other applications (e.g., drawer latch, cabinet latch, etc.).

The lever 10 rotates to move the latch assembly 12. The latch assembly 12 includes, among other things, a latch 22 that retracts to an open position and extends to a locked position. Another embodiment of the lockset 5 is a lever 10 that actuates the locking and unlocking of interconnected lock assembly (not shown) having, among other things, a latch interconnected to a deadbolt.

Figure 2:
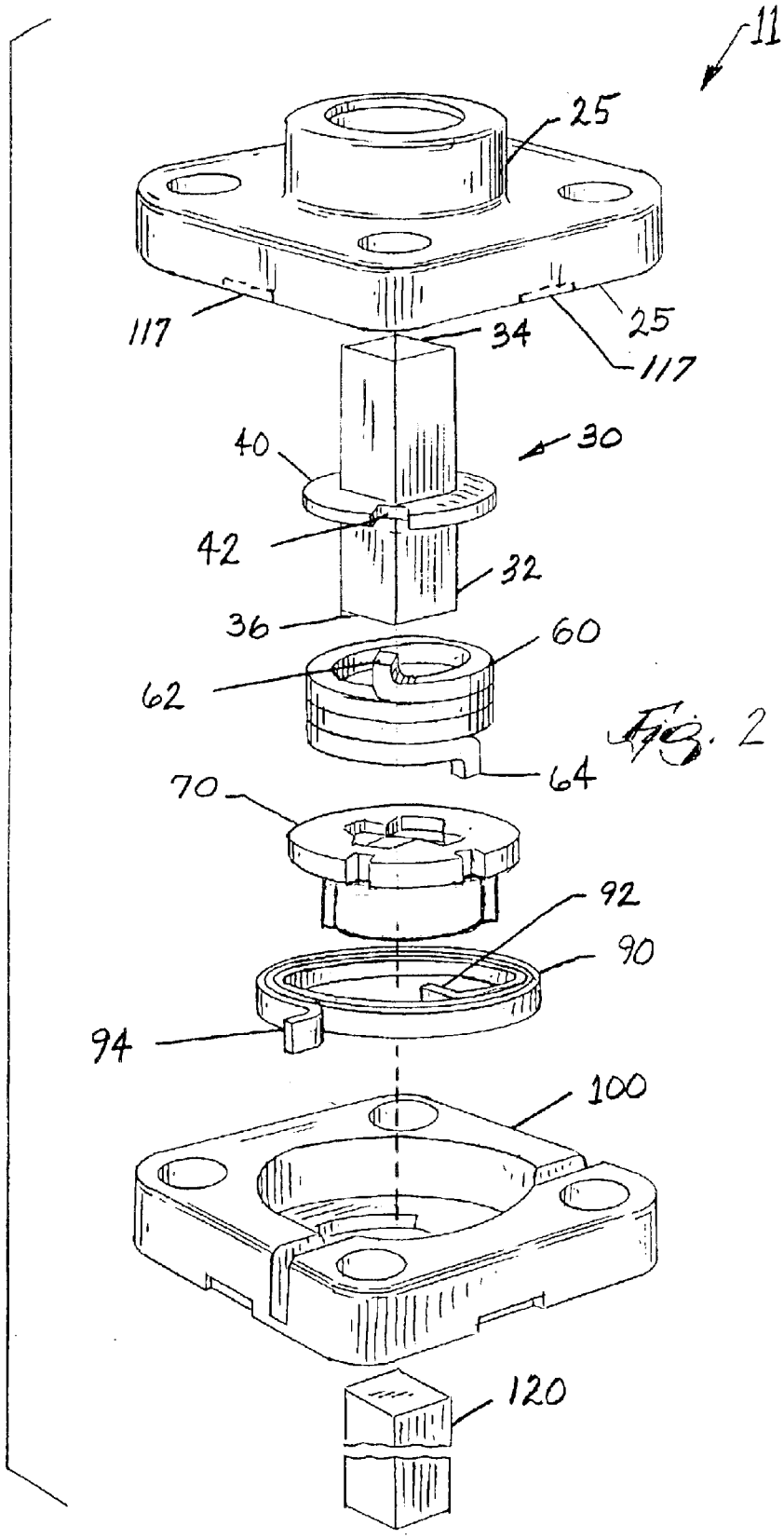
FIG. 2 is an exploded view of an exemplary clutching assembly embodying the invention.

FIG. 2 illustrates an exploded view of the external clutching assembly 11 of the invention. The clutching assembly 11 includes a cover plate 25, an outside spindle 30, a clutching torsion spring 60, a hub 70, a clock spring 90, a cage 100, and an inside spindle 120.

As shown in FIG. 1 and FIG. 2, the exemplary cover or cover plate 25 includes an extension or boss 27 that extends toward the lever 10. The outside spindle 30 partially extends through a hole 28 centered in the boss 27 for connection to the door lever 10. The exemplary boss 27 and the cover plate 25 are shaped and sized to be positioned underneath an escutcheon or rose 29. One embodiment of the boss 27 is circular shaped. Of course, the boss 27 can include other suitable shapes (e.g., square). The cover 25 includes openings 26*a–d* for inserting screws (not shown) to secure the cover 25 to the door 18. In another embodiment, the cover can include adhesive to secure with the door. One embodiment of the cover 25 is comprised of machined metal. Of course, other suitable materials (e.g., cast metal, forged metal, plastic, etc.) known in the art of locksets can be used.

FIG. 2 shows an exemplary outside spindle 30. The exemplary embodiment of the outside spindle 30 includes a square rod or shaft 32 having a first end 34 that connects to the door lever 10 and a second end 36 that connects to the hub 70. Another embodiment of the outside spindle 30 can be a hollow cylinder for connection with the lockset assembly. In yet another embodiment, the spindle 30 can include a shaft 32 having a cross section in other suitable shapes (hexagonal, circular, elliptical, etc.). The length of the shaft 32 can vary for the desired extension of the outside spindle 30 from the cover 25 as well as the depth of the clutching assembly 11. In yet another embodiment, the first end 34 of the spindle 34 can include an extension or recess (not shown) of varying shape and size for engaging or connecting to the door lever 10. The exemplary outside spindle 30 is comprised of cast metal, but other suitable materials known in the art for use with locksets can be used.

The exemplary outside spindle 30 also includes a catch plate 40 positioned perpendicular to the central axis and along the length of the shaft 32. Of course, the position of the plate 40 along the shaft 32 can vary for the size of the clutching torsion spring 60 and the desired length of shaft 32 extending through the cover 25. The exemplary shape of the catch plate 40 is circular (i.e., a washer) to conform to the exemplary shape of the clutching torsion spring 60 and clock spring 90. Alternatively, the catch plate 40 can be in other suitable shapes (e.g., square, octagonal, etc.) for operating with the clutching assembly 11. The exemplary catch plate 40 is integral to the shaft 32 using any suitable connection means (e.g., spot-weld, threaded groove, cast) for operation with the clutching torsion spring 60. The catch plate 40 includes a slot 42 located along the plate's perimeter. The slot 42 can have any suitable shape (e.g., slit, notch) and position along the perimeter to attach the outside spindle 30 to the clutching torsion spring 60. Alternatively, the catch plate 40 can include other suitable connections means (e.g., rivet, spot-weld) to attach the end of the clutching torsion spring 60. Additionally, the catch plate 40 can include more than one slot 42 for attachment to a plurality of clutching torsion springs 60. The exemplary outside spindle 30 is comprised of cast metal. Alternatively, the outside spindle 30 and catch plate 40 can be comprised of other suitable materials (e.g., forged metal) known in the art for use in a lockset 5.

The exemplary clutching torsion spring 60 has a spring constant and shape to bias the outside spindle 30 from a rotated position to return to its original position. The clutching torsion spring 60 includes a first end 62 and a second end 64. The exemplary embodiment of the ends 62 and 64 includes bends 66 and 68 respectively. The bend 66 of the clutching torsion spring 60 attaches to the slot 42 of the catch plate 40 on the outside spindle 30. The second bend 68 attaches to one of the slots (discussed below) located on the hub 70. Of course, other means (e.g., pin, spot-weld, etc.) can be used to attach the ends 62 and 64 of the clutching torsion spring 60 to the outside spindle 30 and hub 70. One embodiment of the clutching torsion spring 60 is comprised of cast metal. Alternatively, other suitable materials (e.g., steel, plastic) known in the art of locksets can be used.

Figure 3:
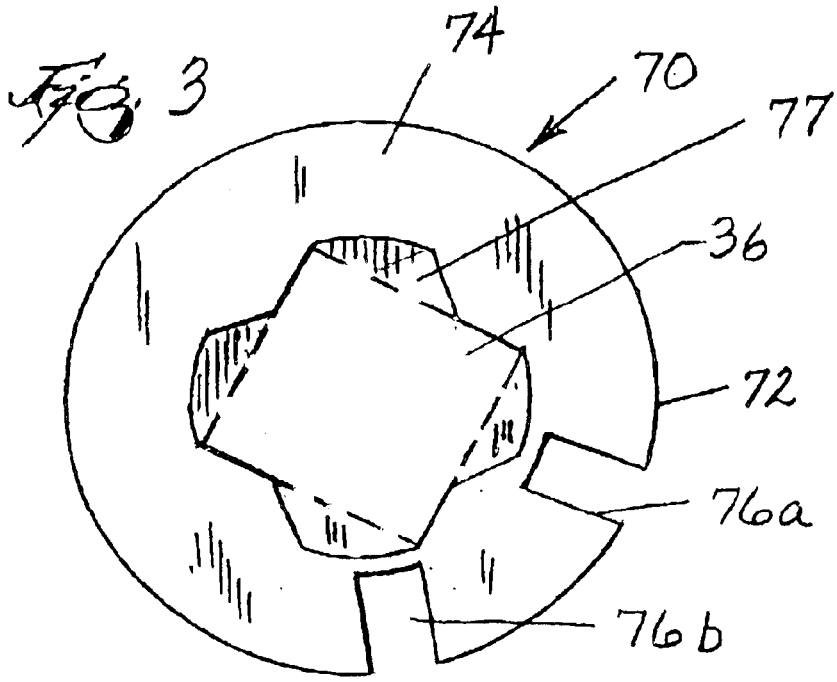
FIG. 3 is a top view of an outside spindle positioned in hub embodying the invention.
Figure 4:
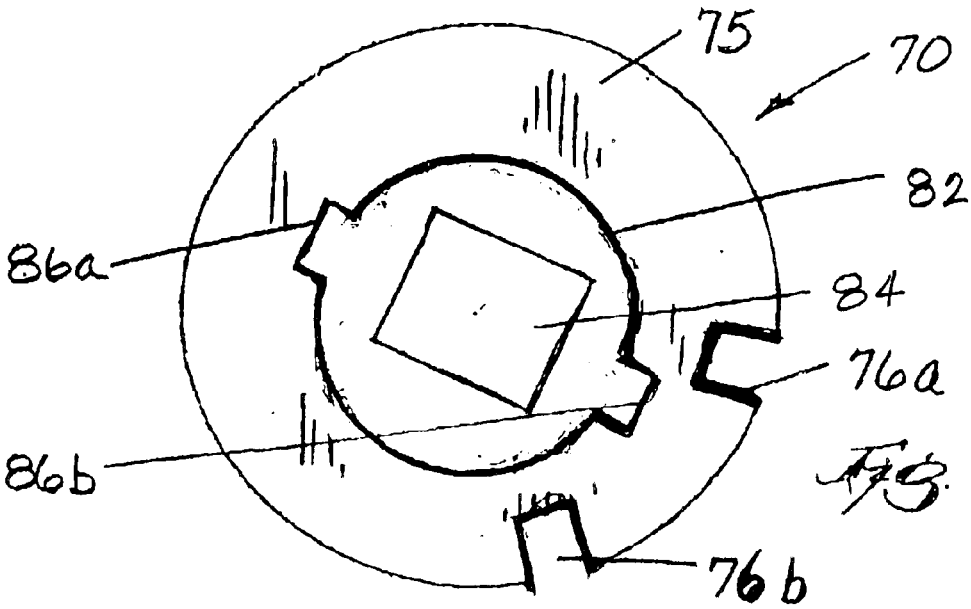
FIG. 4 is a bottom view of hub embodying the invention.

As shown in FIG. 2, the hub 70 interconnects with the outside spindle 30 and the cage 100. FIGS. 3 and 4 illustrate an exemplary hub 70 having a cylindrical disk element 72 having a first face 74 and a second face 75. The disk element 72 is of size and shape such that it lies inside and rotates freely within the cage 100. One embodiment of the assembly 5 includes a lubricant that allows the hub 70 to more easily rotate in the cage 100. As shown in FIG. 3, the first face 74 of the hub 70 includes slots 76*a* and 76*b* (similar to the slot described above in the outside spindle) located along the perimeter of the disk 72. Slot 76*a* receives the second end 64 clutching torsion spring 60 slot 76*b* receives the first end (discussed later) of the clock spring 90. The first face 74 of the hub 70 also includes a first recess 77 for at least partially receiving the second end 36 (in dash) of the outside spindle 30. The recess 77 of shape to enable the outside spindle 30 to partially-pivot or rotate with respect to the hub 70.

As shown in FIG. 4, the hub 70 also includes a boss or extension 82 integral to the second face 75 of the disk element 72. An interior recess 84 is located central to the extension 82 and is generally square-shaped for at least partially receiving the square-shaped end of the exemplary inside spindle 120. Of course, the recess 84 can be other shapes (e.g., circular) suitable for receiving the inside spindle 120. The recess 84 is generally back-to-back with the recess 77. The exterior of the extension 82 is generally circular-shaped for insertion in an opening (discussed below) of the cage 100. Of course, the exterior of the recess 84 can be other suitable shapes that are compatible with the opening in the cage 100. The exterior of the extension component 82 further includes key elements 86*a* and 86*b* positioned at opposite sides extending outward from the extension component 82. The key elements 86*a* and 86*b* allow the hub 70 to rotate a certain threshold degree when the inside spindle 50 is constrained, such as by a latch assembly 12 in the locked position.

As shown in FIG. 2, the clock spring 90 is of shape and size to be positioned around the perimeter of the hub 70 and within the cage 100. The clock spring 90 interconnects with the hub 70 and the clutching torsion spring 40, providing a part of the spring-over-spring clutching feature of the outside and inside spindles 30, 120. The clock spring 90 includes an inside bend 92 and an outside bend 94. The inside bend 92 attaches to slot 76*b* of the hub 70. In another embodiment, the inside bend 92 of the clock spring 90 can attach to slot 76*a* of the hub 70 and the bend 64 of the torsion spring 60 can attach to slot 76*b* of the hub 70. The outside bend 94 of the clock spring 90 attaches to the cage 100.

Alternatively, the outside bend 94 of the clock spring 90 can attach to a fixed diameter ring that fits inside the cage 100 and supports the compression of the clock spring 90. The exemplary clock spring 90 is comprised of cast metal. Of course, the clock spring 90 can be comprised of other suitable materials known in the art.

Figure 5:
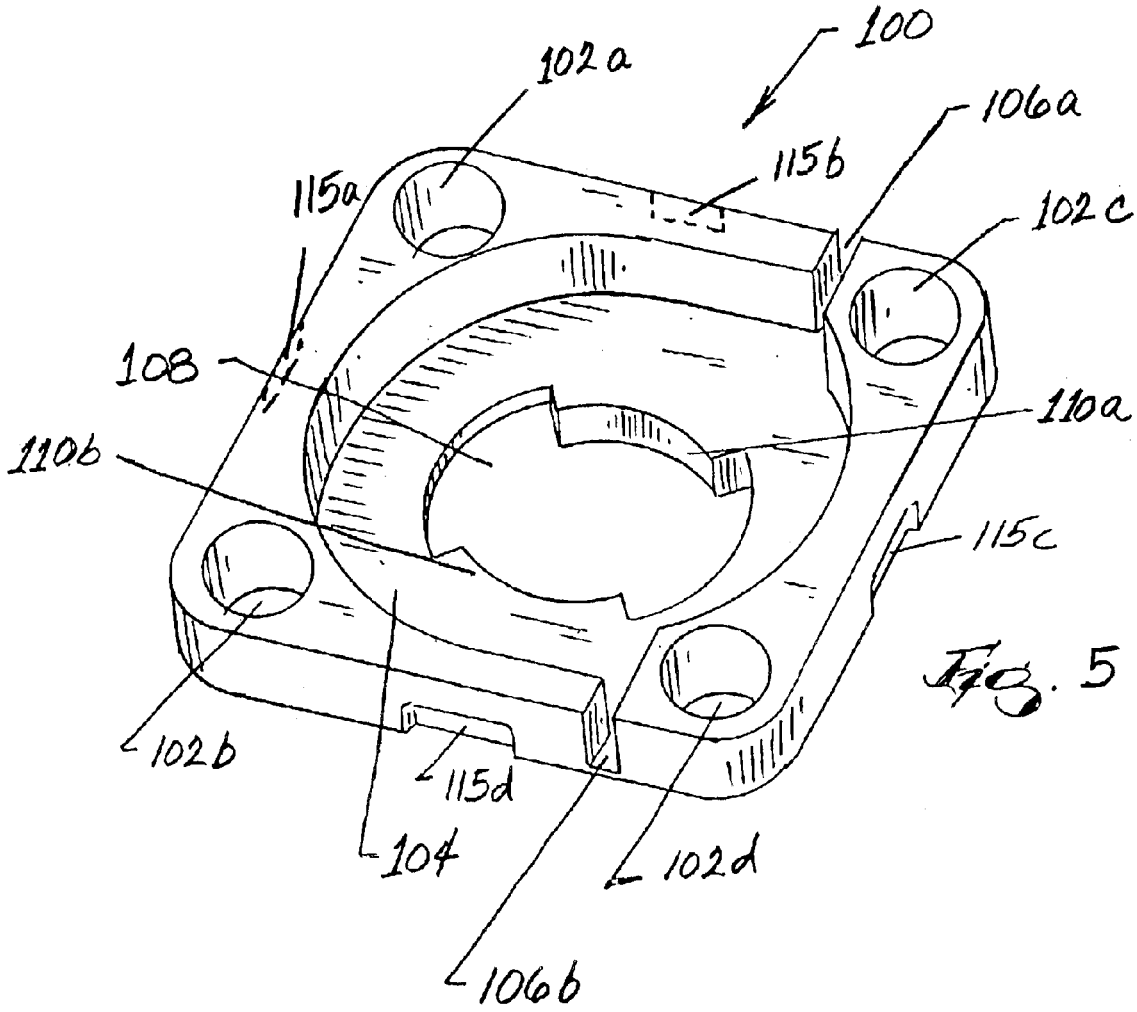
FIG. 5 is a perspective view of a cage embodying the invention.

FIG. 5 is a perspective view of an exemplary cage 100 embodying the invention. The cage 100 interconnects the clock spring 90 and hub 70 with the inside spindle 120 as shown in FIG. 2. The exemplary cage 100 includes four openings 102 *a–d* aligned with the openings 26*a–d* in the cover 25. The openings 102*a–d* provide for insertion of screws to mount the clutching assembly 11 to the door 18. The cage 100 further includes a recess 104 of size and shape for at least partially receiving the hub 70. The exemplary recess 104 is substantially circular for receiving the clock spring 90 and attached hub 70. The cage 100 also includes two slots 106*a* and 106*b* located on opposite sides. The second end 94 of the clock spring 90 inserts in one of the two slots 106*a* and 106*b*, depending upon whether the latch assembly 12 is right handed or left handed.

The cage 100 also includes an opening 108 central to the recess 104 for receiving the extension component 82 of the hub 70. The exemplary opening 108 is circular shaped such that the hub 70 can partially rotate inside the opening 108. The perimeter of the opening 108 includes stops 110*a* and 110*b*. The stops 110*a* and 110*b* are designed to engage the key elements 86*a* and 86*b* of the hub 70. Thereby, the stops 110*a* and 110*b* limit the degree of rotation of the hub 70 and inside spindle 30 in the opening 108. One embodiment of the cage 100 also includes indents 115*a–d* located on each edge of the cage 100. The indents 115*a–d* align with detents 117 (shown in dash in FIG. 2) located on the interior of the cover 25 to align and hold the cage 100 with respect to the cover 25. The exemplary embodiment of the cage 100 is comprised of cast metal. Of course, the cage 100 can be comprised of other suitable materials (e.g., steel, plastic) know in the art for use with lockset assemblies.

The inside spindle 120 connects the latch assembly to the clutching assembly at the hub. When the latch assembly is in the unlocked position, the inside spindle rotates with the lever in extending and retracting the latch. However, when the latch assembly is in the locked position, the latch assembly constrains the inside spindle from rotating. In the locked position, the clutching assembly 11 allows the outside spindle 30 and lever 10 to rotate with a certain degree of freedom. Yet, at a certain threshold of rotation, the lever 10 and clutching assembly 11 are constrained from rotating. In one embodiment, the clutching assembly 11 is designed to provide a rotational freedom of 45 degrees in a clockwise or counterclockwise direction. At the end of this rotational degree of freedom, excessive force exerted on the lever 10 can damage the escutcheon 29 as well as the overall lock assembly 5. In consideration of these event, the exemplary inside spindle 120 is designed to break or snap at a threshold level of force. If the inside spindle 120 breaks, the outside spindle 30 freely rotates without further damage to the lockset assembly 5 or escutcheon 29. Additionally, the lock assembly 5 remains biased in the locked position to secure access through the door 18.

In another embodiment of the invention, the outside spindle 30 and inside spindle 120 can be interchangeable with one another. This embodiment provides greater ease in assembly and replacement of parts. In yet another embodiment, the outside spindle can be designed to break under a certain threshold of force.

As described above, one embodiment of the invention is a mortise lockset assembly that includes an external clutching assembly 11 for securing a door 18. In another embodiment, the clutching assembly 11 of the invention can also be retro-fitted to an existing mortise lockset assembly already installed to a door 18. In yet another embodiment, the clutching assembly 11 can be connected internally between the door 18 and the latch assembly 12. Note, the application of the clutching assembly 11 is not limited to a lockset for a door 18. In yet another embodiment, the clutching assembly 11 can also be connected with other types of locksets used to secure access to other embodiments (e.g., desk drawer, cabinet drawer, garage door, etc.) that includes a handle and latch.

Thus, the invention provides, among other things, an external clutching assembly 11 for application with a lockset assembly 5. Various features and advantages of the invention are set forth in the following claims.

What is claimed is:

1. A clutching assembly, comprising:

a first spindle and a second spindle;

a hub having a first recess on a top side and a second recess on a bottom side, the first recess for receiving the first spindle and the second recess for receiving the second spindle;

a cage having an opening for receiving the second spindle;

a clutching torsion spring having a first end and a second end, the first end of the clutching torsion spring connected to the first spindle and the second end of the clutching torsion spring connected to the hub; and a clocking spring having a first end and a second end, the first end of the clocking spring connected to the hub and the second end of the clocking spring connected to the cage wherein the first spindle rotates when the second spindle is constrained with respect to the cage.

2. The clutching assembly as claimed in claimed claim 1, further comprising:

a door lever; and a lockset assembly having a latch that secures access through a door wherein the first end of the first spindle is connected to a door lever and the second end of the second spindle is connected to a lockset assembly such that the door lever rotates when the second spindle is constrained by the latch of the lockset assembly.

3. The clutching assembly as claimed in claim 1, further comprising a cover and a plurality of connecting elements that fixedly attaches the cover and the cage.

4. The clutching assembly as claimed in claim 1, wherein the first spindle further includes a plate positioned perpendicular to and along a length of a rod, the plate biasing against the clutching torsion spring.

5. The clutching assembly as claimed in claim 4, wherein the plate further includes a slot for attaching the first end of the clutching torsion spring.

6. The clutching assembly as claimed in claim 1, wherein the cage further includes a slot to attach the second end of the clocking spring.

7. The clutching assembly as claimed in claim 1, wherein the hub further includes a first slot that connects to the second end of the clutching torsion spring and a second slot that connects to the first end of the clocking spring.

8. The clutching assembly as claimed in claim 1, wherein the hub further includes a first and second stops integral to the first recess such that the first and second stops limit rotation of the first spindle with respect to the hub.

9. The clutching assembly as claimed in claim 1, wherein the second recess of the hub is positioned in an extension from the hub, and the cage further includes a cage opening for receiving the extension of the hub.

10. The clutching assembly as claimed in claim 9, wherein the extension of the hub further includes a first and a second external stops.

11. The clutching assembly as claimed in claim 10, wherein the cage opening further includes a first and second cage stops, such that the cage stops engage the external stops of the hub in limiting rotation of the hub with respect to the cage.

12. The clutching assembly as claimed in claim 1, wherein the cage further includes a recess central to the cage for receiving the hub and the clock spring.

13. The clutching assembly as claimed in claim 1, wherein the cage further includes a first and a second sot for attaching the clock spring, the first and second slots corresponding to a left-handed and a right-handed opening lockset assembly.

14. A lockset assembly for a door, the lockset assembly comprising:

a door lever;

a latch assembly having a latch that retracts to a unlocked position and extends to a locked position;

a first spindle having a first end connected to the door lever and an opposing second end;

a second spindle having a first end connected to the latch assembly and an opposing second end;

a hub that abuts between the second end of the first spindle and the second end of the second spindle;

a cage fixedly attached to a door;

a clutching torsion spring that interconnects the first spindle and the hub; and a clock spring that interconnects the hub and the cage;

wherein the door lever and connected first spindle rotates when the second spindle is constrained by the latch assembly.

15. The lockset assembly as claimed in claim 14, further comprising a cover and a plurality of connecting elements that fixedly attaches the cover and the cage.

16. The clutching assembly as claimed in claim 14, wherein the first spindle further includes a plate positioned perpendicular to and along a length of a rod, the plate biasing against the clutching torsion spring.

17. The clutching assembly as claimed in claim 14, wherein the plate further includes a slot for attaching the first end of the clutching torsion spring.

18. The clutching assembly as claimed in claim 14, wherein the cage further includes a slot to attach the second end of the clocking spring.

19. The clutching assembly as claimed in claim 14, wherein the hub further includes a first slot that connects to the second end of the clutching torsion spring and a second slot that connects to the first end of the clocking spring.

20. The clutching assembly as claimed in claim 14, wherein the hub further includes first and second stops, such that the first and second stops limit rotation of the first spindle with respect to the hub.

21. The clutching assembly as claimed in claim 14, wherein the hub has a recess positioned in an extension from the hub, and the cage further includes a cage opening for receiving the extension of the hub.

22. The clutching assembly as claimed in claim 14, wherein the hub has an extension that includes first and second external stops.

23. The clutching assembly as claimed in claim 14, wherein the cage has an opening that includes first and second cage stops, such that the cage stops engage the external stops of the hub in limiting rotation of the hub with respect to the cage.

24. The clutching assembly as claimed in claim 14, wherein the cage further includes a recess positioned central to the cage for receiving the hub and the clock spring.

25. A lockset assembly for a door, the lockset assembly comprising:

a door lever;

a latch assembly having a latch that retracts to a unlocked position and extends to a locked position;

a first spindle having one end connected to the door lever;

a second spindle having one end connected to the latch assembly;

a hub that abuts between the other end of the first spindle and the other end of the second spindle;

a cage fixedly attached to a door and including a slot;

a clutching torsion spring that interconnects the first spindle and the hub; and a clock spring that interconnects the hub and the cage, the spring having first and second ends, the second end being attached to the cage slot;

wherein the door lever and connected first spindle rotates when the second spindle is constrained by the latch assembly.

26. A lockset assembly for a door, the lockset assembly comprising:

a door lever;

a latch assembly having a latch that retracts to a unlocked position and extends to a locked position;

a first spindle having one end connected to the door lever;

a second spindle having one end connected to the latch assembly;

a hub that abuts between the other end of the first spindle and the other end of the second spindle, the hub including a first slot and a second slot;

a cage fixedly attached to a door;

a clutching torsion spring that interconnects the first spindle and the hub, the spring having an end connected to the first slot of the hub; and a clock spring that interconnects the hub and the cage, the clocking spring having an end connected to the second slot of the hub;

wherein the door lever and connected first spindle rotates when the second spindle is constrained by the latch assembly.

27. A lockset assembly for a door, the lockset assembly comprising:

a door lever;

a latch assembly having a latch that retracts to a unlocked position and extends to a locked position;

a first spindle having one end connected to the door lever;

a second spindle having one end connected to the latch assembly;

a hub that abuts between the other end of the first spindle and the other end of the second spindle, the hub having an extension and a recess positioned in the extension;

a cage fixedly attached to a door and including a cage opening for receiving the extension of the hub;

a clutching torsion spring that interconnects the first spindle and the hub; and a clock spring that interconnects the hub and the cage;

wherein the door lever and connected first spindle rotates when the second spindle is constrained by the latch assembly.

* * * * *